US009077112B2

(12) United States Patent
Mitchell et al.

(10) Patent No.: US 9,077,112 B2
(45) Date of Patent: Jul. 7, 2015

(54) ELECTRICAL CONNECTORS

(75) Inventors: Patrick Mitchell, Southampton (GB); Gary Kirkland, Southampton (GB)

(73) Assignee: Southern Electric Contracting Limited, Reading (GB)

( * ) Notice: Subject to any disclaimer, the term of this patent is extended or adjusted under 35 U.S.C. 154(b) by 0 days.

(21) Appl. No.: 13/696,116

(22) PCT Filed: May 6, 2011

(86) PCT No.: PCT/GB2011/050884

§ 371 (c)(1),
(2), (4) Date: Dec. 27, 2012

(87) PCT Pub. No.: WO2011/138618

PCT Pub. Date: Nov. 10, 2011

(65) Prior Publication Data

US 2013/0130522 A1 May 23, 2013

(30) Foreign Application Priority Data

May 6, 2010 (GB) ..... 1007558.8
May 6, 2010 (GB) ..... 1007561.2

(51) Int. Cl.
*H01R 13/44* (2006.01)
*H01R 13/639* (2006.01)
*H01R 13/625* (2006.01)

(52) U.S. Cl.
CPC ..... *H01R 13/6397* (2013.01); *H01R 13/625* (2013.01)

(58) Field of Classification Search
CPC ..... H01R 13/625; H01R 13/0485; H01R 13/622; H01R 13/6397
USPC ..... 439/133, 131, 246–248, 578, 314, 317, 439/332–333, 140
See application file for complete search history.

(56) References Cited

U.S. PATENT DOCUMENTS

| | | | |
|---|---|---|---|
| 3,500,291 | A | 3/1970 | Hubbell et al. |
| 4,708,661 | A | 11/1987 | Morland et al. |
| 5,108,297 | A | 4/1992 | Hoffman et al. |
| 5,685,730 | A | 11/1997 | Cameron et al. |

(Continued)

FOREIGN PATENT DOCUMENTS

| | | | |
|---|---|---|---|
| GB | 1454829 | A | 11/1976 |
| GB | 2292268 | A | 2/1996 |
| GB | 2356496 | A | 5/2001 |
| GB | 2380868 | A | 4/2003 |
| JP | JP-S499982 | Y1 | 3/1974 |
| JP | JP-S6337579A | A | 2/1988 |
| WO | WO-2012047386 | A2 | 4/2012 |
| WO | WO-2012074641 | A1 | 6/2012 |
| WO | WO-2012151339 | A1 | 11/2012 |

OTHER PUBLICATIONS

Camerer, Stephan, "International Search Report" for PCT/GB2011/050884, as mailed Aug. 3, 2011, 3 pages.

*Primary Examiner* — Jean F Duverne
(74) *Attorney, Agent, or Firm* — Winstead PC

(57) ABSTRACT

A socket (1) comprises a plurality of contacts (10, 11, 12 and 20, 21, 22) arranged for electrical connection with a plug (2, 2'), electrical connection between the plug and socket being made by insertion of the plug into the socket and subsequent relative rotation (9R) of the plug and socket about a common axis (9A), at least a first electrical contact (10, 11, 12) having a contact face (14, 14', 14") in a plane (1P, 1P', 1P") substantially parallel to the common axis (9A), and at least a second electrical contact (20, 21, 22) having a contact face (24, 24', 24") in a plane (1Q) substantially perpendicular to the common axis (9A). Each of the said contact faces arranged for making electrical contact with the plug (2, 2').

13 Claims, 6 Drawing Sheets

(56) References Cited

U.S. PATENT DOCUMENTS

| | | | | |
|---|---|---|---|---|
| 6,305,963 | B1 * | 10/2001 | Felps | 439/317 |
| 6,517,359 | B1 | 2/2003 | Felps et al. | |
| 6,524,123 | B2 * | 2/2003 | Kedrowski et al. | 439/131 |
| 6,751,856 | B2 * | 6/2004 | Kedrowski et al. | 29/832 |
| 6,933,713 | B2 * | 8/2005 | Cannon | 324/72.5 |
| 7,637,766 | B2 | 12/2009 | Kauffman et al. | |
| 8,038,481 | B1 | 10/2011 | Creighton et al. | |
| 8,398,435 | B2 | 3/2013 | Aurongzeb et al. | |
| 8,864,514 | B2 | 10/2014 | Ilyes | |
| 2014/0302715 | A1 | 10/2014 | Wagner et al. | |

* cited by examiner

ELECTRICAL CONNECTORS

The present invention relates to electrical connectors for making a disconnectable pluggable connection between a socket and a plug.

A problem with known electrical connectors for pluggable connection is that they may be easily disconnected by unauthorised persons. Electrical connectors and or coupling devices such as known plug and socket arrangements are normally arranged for repeated easy connection and disconnection. A particular problem arises where such electrical connectors are located in public spaces, and it is not possible to prevent public access to the electrical connector. Such accessible electrical connectors are at risk of an unauthorised member of the public disconnecting the electrical connection. Such disconnection may have serious consequences for the safety of others, and if the electrical apparatus that was connected is stolen, this may cause the legitimate owner to incur significant replacement costs.

A particular example of one such publicly accessible location is on street lighting apparatus, where a disconnectable pluggable electrical connector is required for mounting a dusk-dawn sensor switch at the luminaire head. Such dusk-dawn sensors are collected by certain members of the public, causing the public authority responsible for maintaining the street lighting great inconvenience and costs. A dangerous situation may be created for other members of the public using the streets, where the lighting was essential for their safe passage.

A further problem with providing electrical connectors for pluggable connection, and particularly those for control for switching street lighting is that they must be arranged for operation in an exposed location, where they are subject to extremes of the weather, including wet conditions, high temperatures from daytime sunshine, and low temperatures from winter night times.

It is an object of the present invention to provide an improved socket arranged for electrical connection to a plug. This object can be achieved by the features as defined by the independent claim. Further enhancements are characterized by the dependent claims.

According to the present invention, there is provided a socket comprising a plurality of contacts arranged for electrical connection with a plug, electrical connection between the plug and socket being made by insertion of the plug into the socket and subsequent relative rotation of the plug and socket about a common axis, at least a first electrical contact having a contact face in a plane substantially parallel to the common axis, and at least a second electrical contact having a contact face in a plane substantially perpendicular to the common axis, each of said contact faces arranged for making electrical contact with the plug.

Preferably the socket further comprises a frontplate having an externally facing surface, the contacts being disposed substantially flush with or behind the externally facing surface, apertures being provided though the externally facing surface to receive plug pins, the apertures arranged such that the plug pins may make electrical contact with a corresponding contact when a plug is fully inserted in the socket.

Preferably the socket further comprises a first set of a plurality of first electrical contacts and a second set of a plurality of second electrical contacts, the first set of contacts being radially disposed about the common axis at a first pitch circle radius, and the second set of contacts being radially disposed about the common axis at a second pitch circle radius.

Preferably the first pitch circle radius is less than the second pitch circle radius.

Preferably at least one aperture for one of the sets of contacts is of a different shape to at least another aperture for that set of contacts; preferably the said set of contacts being the first set.

Preferably the contacts are resiliently urged to make electrical contact with corresponding plug pins.

Preferably on insertion of a plug into the socket, electrical connection is made between the at least first electrical contact and a corresponding first plug pin before an electrical connection is made to the at least a second electrical contact and a corresponding second plug pin.

Preferably on insertion of a plug into the socket, the plug is removably retained in the socket by the subsequent relative rotation of the plug and socket.

Preferably the at least first electrical contact further comprises a protrusion extending in a circumferential direction, the protrusion arranged to abut a rearward facing surface of the frontplate on the subsequent relative rotation.

Preferably the socket is provided with a locking means, the locking means comprising at least a member moveable in a direction parallel with the common axis to engage the plug when connected to the socket and following the subsequent relative rotation.

Preferably the locking means further comprises a latching means is provided to latchably retain the member in an engaged position; the latching means being preferably provided in the socket.

Preferably the locking means is arranged to be only operable from within an enclosed space; preferably the enclosed space being or extending behind the socket frontplate.

In a further aspect of the present invention, there is provided a plug for connection to an electrical socket as described herein and according to the further embodiment of invention.

Preferably the plug is arranged with a mating face substantially perpendicular to the common axis, the mating face arranged to face the frontplate externally facing surface when the plug is inserted in the socket, the plug further comprising at least a first set of a plurality of pins arranged for making electrical contact with the first electrical contacts and a second set of a plurality of pins arranged for making electrical contact with the second electrical contacts, the first set of contacts protruding the mating face further than the second set of pins.

An embodiment of the present invention relates to electrical connectors for making a disconnectable pluggable connection, and more particularly to such connectors arranged so that unauthorised disconnection may be prevented.

According to a further embodiment of the invention there is provided a socket for making an electrical connection with a plug, electrical connection between the plug and socket being made by insertion of the plug into the socket and subsequent relative rotation of the plug and socket about a common axis, the socket having a locking means, the locking means comprising at least a member moveable in a direction parallel with the common axis to engage the plug when electrically connected to the socket so as to lock the plug to the socket.

A benefit of the invention is that a locking means may be provided to prevent the disconnection of a plug from a socket, where the connection is made by insertion of the plug into the socket and subsequent relative rotation of the plug and socket about the common axis.

Preferably a latching means is provided to latchably retain the member in an engaged position; the latching means being preferably provided in the socket.

Preferably the socket further comprises a frontplate, the latching means being operable from between the engaged position and a retracted position; the member being preferably behind an externally facing surface of the frontplate when in the retracted position; the latching means being preferably arranged to releasably retain the member in the retracted position; preferably the latching means being resiliently latched in the retracted position and the engaged position.

Preferably in an alternative embodiment the member is resiliently urged from the retracted position to the engaged position.

Preferably the member further comprises a bar having a longitudinal axis, the longitudinal axis being substantially parallel with and offset from the common axis.

Preferably the socket further comprises a plurality of contacts arranged for disconnectable connection to plug pins, the contacts being radially disposed about the common axis within a maximum radius, the longitudinal axis being within the maximum radius.

Preferably the locking means is arranged so that the member is arranged for manipulation to the engaged position, the manipulation being only from behind the socket frontplate.

A benefit of the locking means being operable only from behind the socket frontplate is that the locking means is hidden from view when a plug is inserted and locked in the socket.

Preferably the latching means is arranged for manipulation to the retracted position, the manipulation being only from behind the socket frontplate.

A benefit of the locking means and the latching means being operable only from behind the socket frontplate is that the locking means and latching means are protected from unauthorised operation.

Preferably the latching means is arranged for retraction to the retracted position, the retraction being only by application of an electrical signal.

In a further aspect of the present invention, there is provided a plug for connection to an electrical socket as described herein and according to the invention.

Preferably the plug comprises at least an abutment to abut the member when engaged.

Preferably the plug is prevented from relative rotation when the member is engaged.

Preferably the plug and socket as described herein and according to the invention are provided for use as set.

Throughout this specification, unless the context requires otherwise, the word "comprise" or variations such as "comprises" or "comprising" will be understood to imply the inclusion of a stated integer or group of integers, but not the exclusion of any other integer or group of integers.

Specific embodiments of the invention will now be described by way of example with reference to the accompanying drawings in which.

Figure 1:
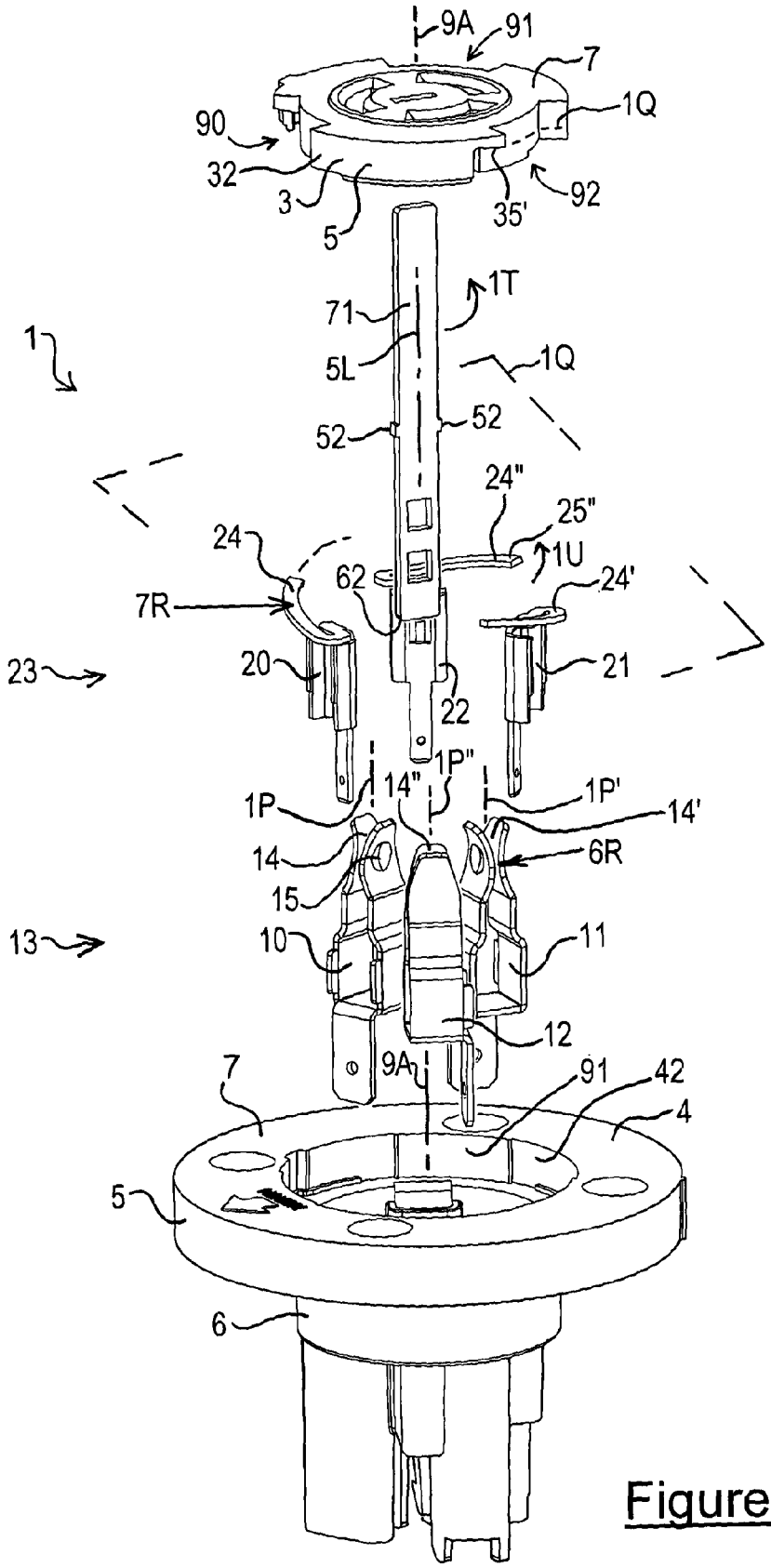
FIG. 1 is an exploded perspective view of a first embodiment of an electrical socket according to the invention.

From FIG. 1 an exploded perspective view of a first embodiment of an electrical socket 1 according to the invention is shown. The socket 1 is arranged for making an electrical connection with a plug, such as plug 2 (shown in FIG. 8). The socket 1 has a frontplate 5 which in this embodiment is comprised of top 3 and annular mounting 4 of the base 6.

Figure 6:
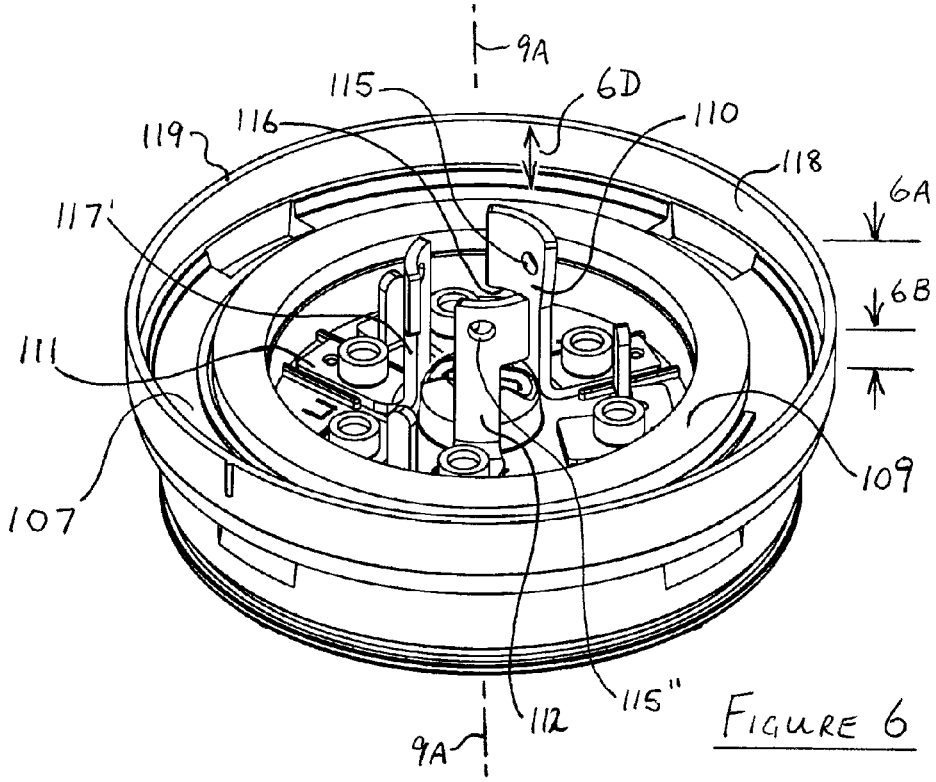
FIG. 6 is a perspective view of a first plug for electrically connecting to a socket as shown in FIG. 1, the view shown from the pin side.
Figure 7:
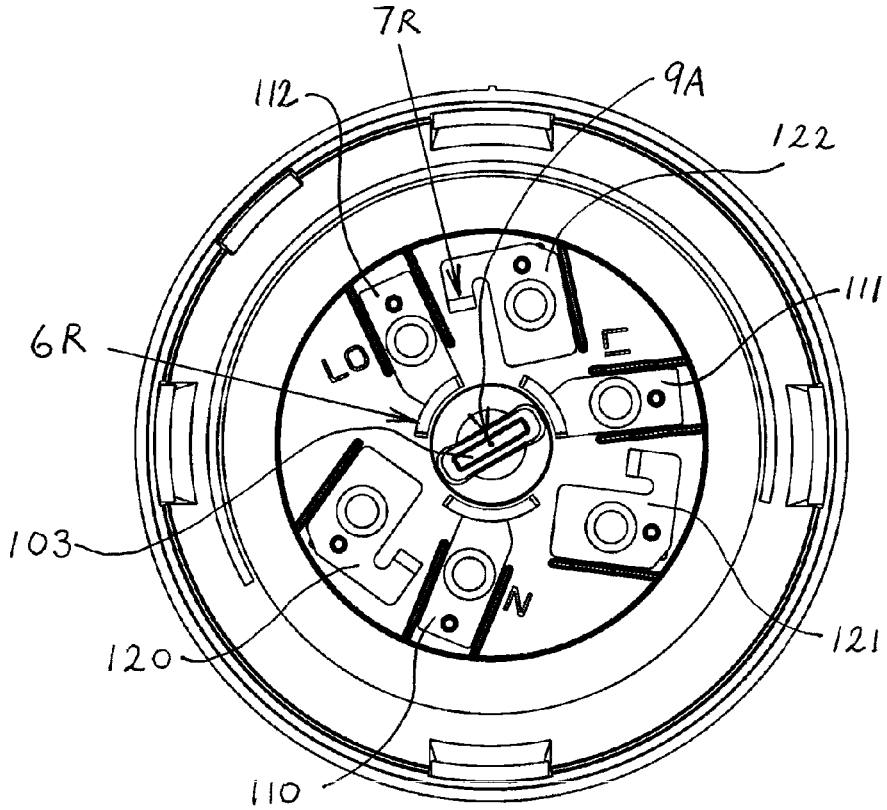
FIG. 7 is a plan view of the plug shown in FIG. 6, the view shown from the pin side.

The socket 1 is provided with a plurality of contacts 10, 11, 12 and 20, 21, 22, each contact arranged for electrical connection with a corresponding plug pins 110, 111, 112 and 120, 121, 122 respectively (shown in FIGS. 6 and 7). The contacts are arranged in tow sets, a first set 13 of a plurality of first electrical contacts 10, 11, 12 and a second set 23 of a plurality of second electrical contacts 20, 21, 22. The first set of contacts are radially disposed about the common axis 9A at a first pitch circle radius 6R, and the second set of contacts being the contacts being radially disposed about the common axis 9A at a second pitch circle radius 7R. The first pitch circle radius 6R is less than the second pitch circle radius 7R. Each first electrical contact 10, 11, 12 is arranged with a contact face 14, 14', 14" in a plane 1P, 1P' and 1P" respectively, each substantially parallel to the common axis, the planes in effect lying on or tangential to a cylindrical surface about and having as a centre the common axis 9A. Each of the second electrical contacts has a contact face 24, 24', and 24" in a plane 1Q substantially perpendicular to the common axis. Each of the said contact faces are arranged for making electrical contact with the corresponding plug pins.

Figure 2:
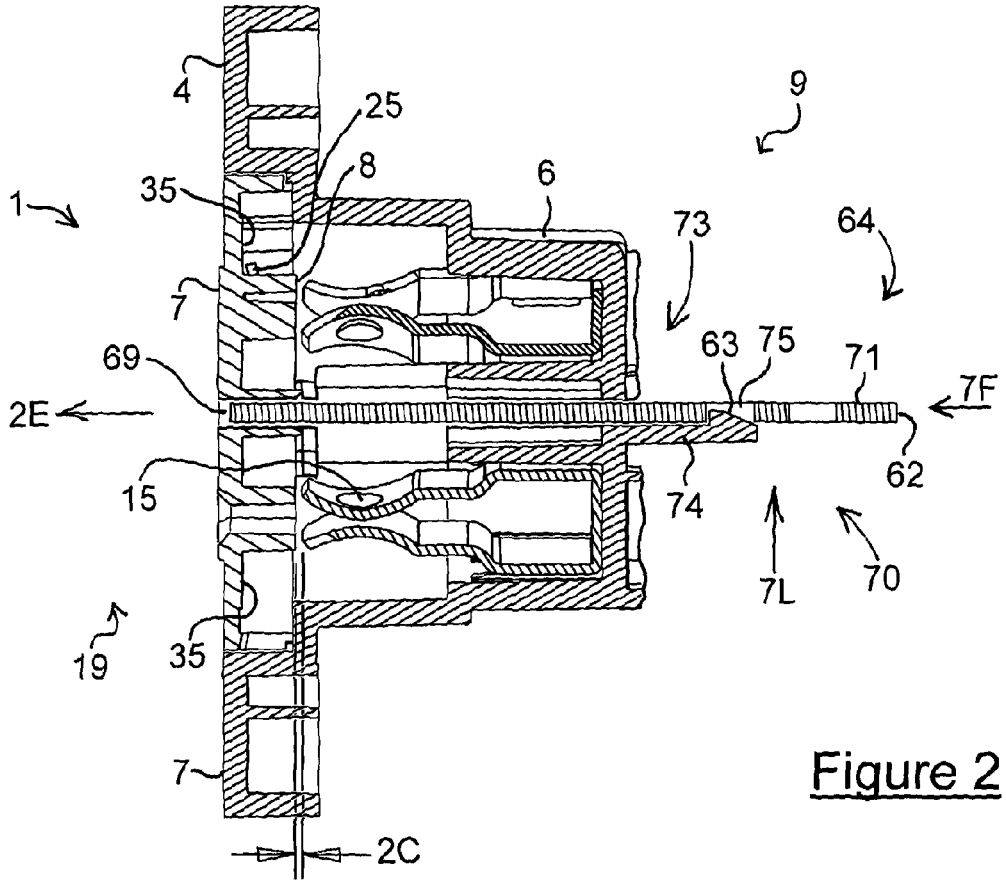
FIG. 2 is a cross sectional scrap side view of the socket shown in FIG. 1 on line AA of FIG. 5.
Figure 8:
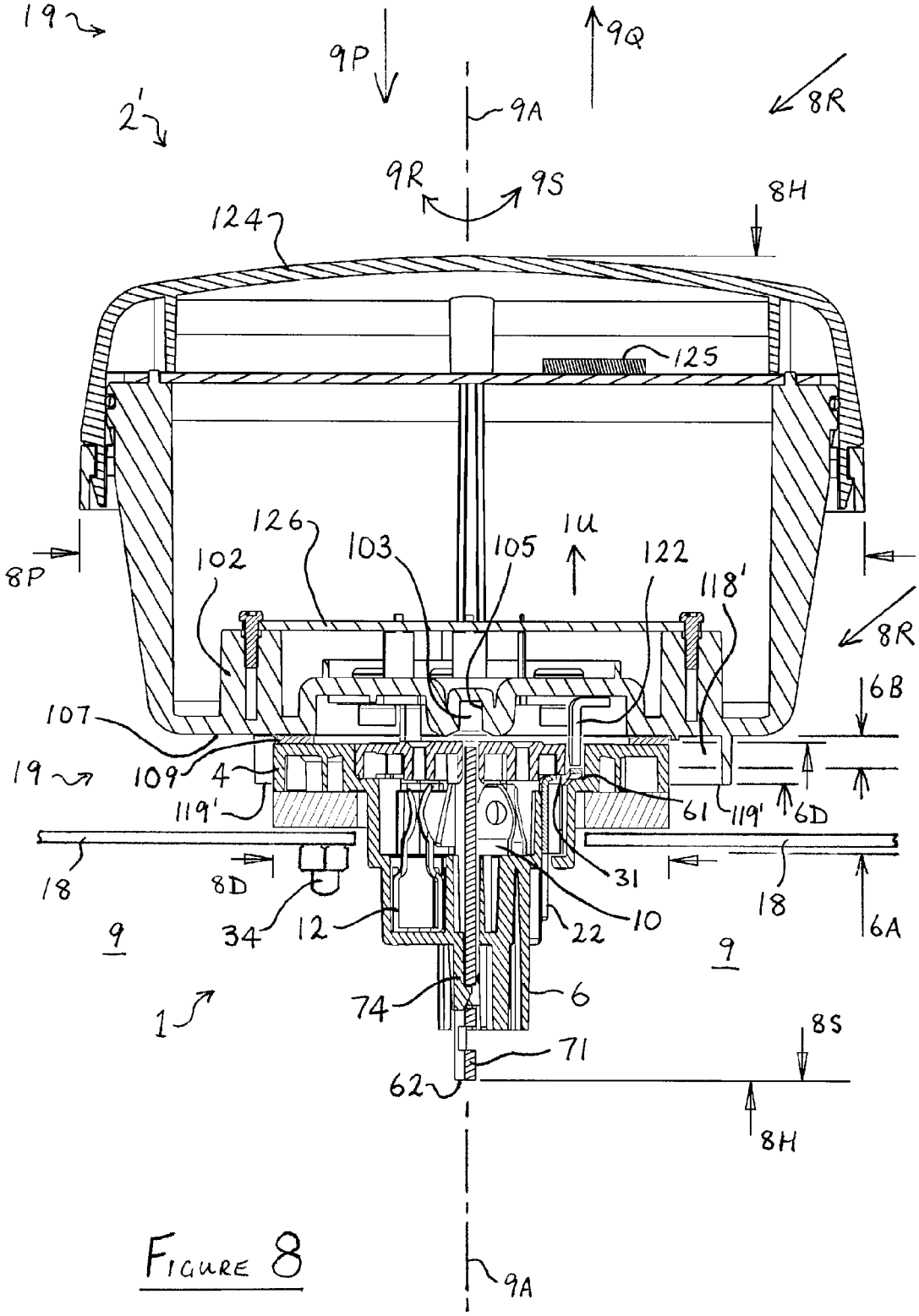
FIG. 8 is a cross-sectional side view of a second plug with the same contact arrangement as the first plug shown in FIG. 6, the second plug being shown fitted to the socket of FIG. 1.

From FIGS. 2 and 8 it can be seen that the contacts are all disposed substantially behind an externally facing surface 7 of the frontplate 5. The first contacts 10, 11, 12 are spaced a distance 2C from a rear face 8 of the frontplate 5. The space 2C ensures that the two contact arms of each contact may freely resile towards each other so as to ensure good electrical contact with the corresponding plug pin.

From FIG. 8 second contact 22 can be seen to be supported by surface 61 of base 6, and the contact is retained in the base by rearwardly facing surface 31 of the top plate 3 being a part of frontplate 5. Free end 25" of contact 22 is resiliently urged in an upward direction 1U against plug pin 122 so as to make electrical contact between the socket and the plug. Preferably free end 25" is arranged to rest against a second rearwardly facing surface 35" to ensure that it cannot protrude above the externally facing surface and hence be damaged by removal of a plug from the socket. Hence the free ends 25" resiliently abut rearwardly facing surface, which is a stop 35", behind the externally facing surface 7.

Typically the first set of contacts would be used for a current carrying application. The arrangement of the contacts contacting the plug pins on two opposing faces provides a reliable contact for carrying a current, typically in the range of 1 amp to 6 amps.

Typically the second set of contacts would be used for carrying data or control signals. These are typically low current, low voltage signals.

From FIG. 8, the plug contacts are shown connected to a controller 126 mounted within the plug. The controller is preferably powered from live and neutral connections on plug pins 111 and 110 respectively. The controller is arranged to receive inputs from one or more sources, such as for example light sensor 125 mounted under translucent cover 124, or a remote device, or from a programmable internal memory, so as to control a load or a device connected to the controller. One example of such control, is the switching of a supply to the second live plug pin, 112. Another example of control is the application of an analogue or digital signal across two or more of the second set of plug pins, 120, 121 and 122. When an input from the light sensor 125 is used, the plug and controller 126 may be arranged to operate as a known dusk dawn switch.

In an application, such as street lighting, where the plug is a control means for controlling the street light, the second set of contacts will be used for controlling an electronic ballast or control gear used for powering a lamp in the luminaire or lantern to which the control means is mounted. Such control may include switching the lamp on and off and or dimming the lamp. The control may be exercised using known methods such as a digitally-addressable lighting interface (DALI), an interface circuit responding to a 1-to-10V dc drop across a pair of control connections, or other suitable control arrangement. These methods require additional wiring to each ballast during installation, so that the control means may be connected using a socket, such as the socket arrangement described herein. Additionally, when a control system such as DALI is used, then the second set of contacts may be also used to receive information from the ballast or control gear.

Note that in a street lighting application, such as that described above, the electronic ballasts or control gear will typically default to default setting if no signal is applied to the control connections. The default setting will typically be full brightness. Hence, should a user require to control the lighting with a known pluggable dusk dawn switch having only a first set of contacts, then the socket may be arranged so that it will receive such a switch, and the socket may be connected so that the switch will be able to switch the lamp on and off in a known way.

Figure 3:
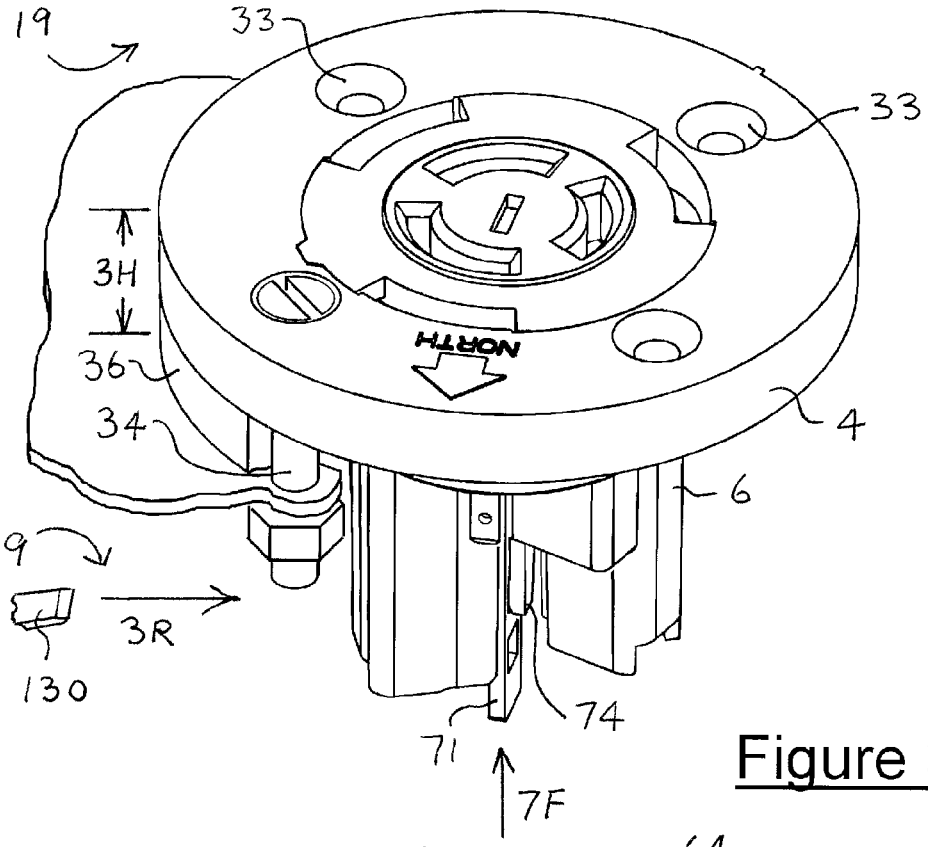
FIG. 3 is a front perspective view of the socket shown in FIG. 1.
Figure 5:
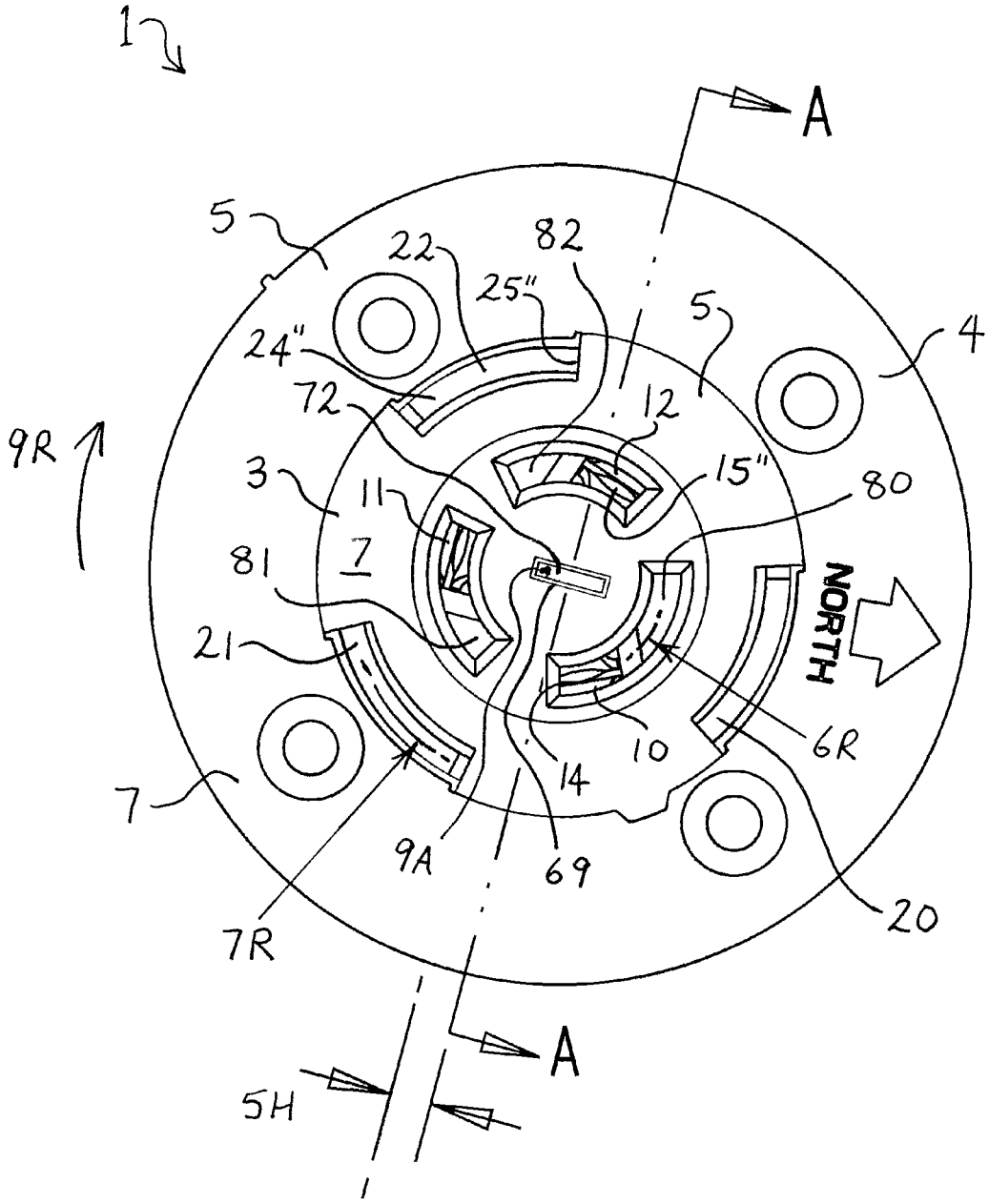
FIG. 5 is a plan view from the front of the socket shown in FIG. 1.

FIGS. 3 and 5 show a first set of apertures 80, 81, 82 arranged to enable plug contacts, such as the plug pins 110, 111, 112 to make electrical contact with the contacts 10, 11, 12 respectively. The apertures 80, 81, 82 are in the externally facing surface 7 and pass through the top plate 3 portion of the frontplate 5. A second set of apertures 90, 91, 92 are provided to enable corresponding plug contacts, such as plug pins 120, 121, 122 to make electrical contact when a plug is fully inserted in the socket. The apertures 90, 91, 92 are though the externally facing surface 7, and formed as a gap between interfitting faces 32 and 42 of the top plate 3 and annular mounting 4 respectively.

Aperture 80 is longer than the apertures 81 and 82, and is arranged to receive plug pin 110 which likewise has a longer arcuate length than the other pins 111 and 112. Hence the plug is arranged so that it can only fit into the socket in one particular orientation, so as to maintain the polarity of the connection. In a particular embodiment, it is convenient to use the plug contact 110 for the neutral connection, and it has been found preferable for contact 110 to protrude further from the plug mating face 107 so that an electrical connection between contact 10 and contact 110 is made before and broken after the connection with the other contacts, including those of the second set of contacts 23.

Since the first contacts 13 are potentially at a high voltage, protection from accidental contact by a user is provided by arranging the apertures to be narrow and for the contacts to be recessed deeply behind the externally facing surface of the frontplate. Since in this particular embodiment, the second contacts 23 are used for signalling and transmission of data purposes, and only a low voltage is required for this, the second set of contacts do not require the same level of protection, and hence may be positioned in a plane 1Q just below the externally facing surface.

In an alternative embodiment not shown herein, at least one or more of the second set of contacts may be flush with the externally facing surface of the frontplate. In a further alternative embodiment not shown herein, one or more of the second set of contacts is formed as a head of a rivet or other protrusion at least a part of which is slightly raised above the immediately surrounding externally facing surface. An example of such a raised head would be a domed rivet head. The raised or domed surface forming an electrical contact to make electrical connection with a plug.

From FIG. 8 a cross-sectional side view of an electric plug 2' is shown fitted to the electric socket 1. While some features of the plug 2 shown in FIGS. 6, 7 and plug 2' shown in FIG. 8 differ, note that item numbers referring to features that are common to both are identical, and aspects that are common are only described with reference to plug 2. Electrical connection between the plug 2 and socket 1 being made by insertion of the plug into the socket in the direction of arrow 9P, and subsequent relative rotation of the plug and socket in a direction of arrow 9R about a common axis 9A. The direction 9P is substantially parallel to that of the common axis 9A, and perpendicular to the plane of rotation 9R. The plane of rotation 9R lies parallel to that of the externally facing surface 7. Rotation of the plug 2 in the socket 1 causes the plug contacts 110, 111, 112 to fully engage the corresponding socket contacts 10, 11, 12. Each of the plug contacts 110, 111, 112 is provided with a hole 115 (see FIG. 6), and each of the socket contacts 10, 11, 12 is provided with raised protrusion 15 (dimple side seen in FIGS. 1 and 2) on contact face 14, which is arranged to engage the corresponding hole 115 when the plug has been fully rotated in the socket. Such engagement provides a tactile feedback that the plug is engaged with the socket, but does not prevent removal of the plug from the socket.

The plug contacts 110, 111, 112 are each provided with hook portions 116 arranged to engage a second rear face 8 of the frontplate 5 when the plug is fully rotated in the socket. The engagement of the hook portions with the rear face 8 ensures the plug is fully inserted and cannot be removed by an axial pull in a direction 9Q away from the socket. The plug is electrically connected to the socket when it is fully inserted in this manner. The hook portions 116 are protrusions extending in a circumferential direction, each of the protrusions arranged to abut a rearward facing surface 8 of the frontplate 5 on the subsequent relative rotation 9R.

A mechanical fixing such as screws or a snap fit arrangement (not shown herein) may be provided to ensure retention of the top plate 3 within the annular mounting 4 so as to safely resist an axial pull out force on the plug in the direction 9Q from the socket when the plug has been fully inserted by rotating within the socket.

Hence to disengage the plug from the socket it must first be rotated in a second direction 9S, which is opposite to the direction 9R to disengage the hook portions 116 from the rear face 8. The plug can then be separated from the socket by an axial pull along the common axis in the direction of arrow 9Q.

In a particular embodiment, it has been found advantageous for the relative heights of the socket contacts and plug pins to be such that the plug may be fully inserted into the socket so that the externally facing surface 7 substantially abuts plug mating face 107 before the second set of contacts make an electrical connection as shown in FIG. 8. More preferably the second set of contacts are arranged so that hook portions 116 have started to engage under the second rear face 8 before the second set of contacts and the corresponding plug pins make electrical contact. As the rotation in the direction or arrow 9R so that the plug and socket are connected, the resilient ends 25, 23' and 25" are acted on by the corresponding plug pins, and the plug is urged away from the socket so that the hooks 116 closely abut face 8. The resilient ends are then resiled away from the second rearwardly facing surface 35, 35', 35". Hence a reliable electrical connection is made that cannot be broken by an axial pull 9Q attempting to separating the plug and socket.

From FIGS. 6 and 8, the plug 2 is shown arranged with the mating face 107 perpendicular to the common axis 9A. The mating face 107 is arranged to face the frontplate externally facing surface 7 when the plug is inserted in the socket 2. The first set of pins 13 protrudes the face 107 a distance 6A and the second set of contacts 23 protrude the face 107 a distance 6B. The distance 6A for protrusion of the first set of contacts is greater than the distance 6A for the protrusion of the second set of pins above the mating face 107. The plug 2 has a skirt 118 & 118' extending around and depending from the mating face 107. The skirt 118 & 118' comprises a depending wall extending a distance 6D from the mating face 107, in a direction towards the socket. Hence when the plug is connected to the socket, the skirt wall 118 & 118' extends around the socket, and in the orientation shown in FIG. 8, which would be typical in, for example, an installation on a street light, the direction 9Q is upwards, and the direction 9P is downwards, and hence driving rain falling in the direction of arrow 8R, would be shielded from the mating face 107. Hence an extremity 119 of the skirt wall 118 & 118' acts as a drip bar to shed rainwater 8R so that it cannot penetrate the socket mating face 107.

In FIG. 8, the skirt wall 118' can be seen to be discontinuous, extending around at least half of the periphery of the mating face. Preferably the skirt wall extends as a continuous wall around the periphery of the mating face.

A resiliently compressible sealing means, namely gasket 109 is provided between the plug mating face 107 and the socket frontplate 5 so as to provide a weatherproof seal to prevent the ingress of water to the electrical contacts. The resiliently compressible sealing means is preferably mounted to the plug, and is preferably arranged as a ring or annular seal to enclose at least an area of the frontplate having the contact apertures.

The socket 1 has a locking means 70 shown in FIG. 2. The locking means 70 comprises at least a member, locking bar 71 which is moveable in a direction 2E parallel with the common axis 9A to engage the plug when electrically connected to the socket.

Figure 2A:
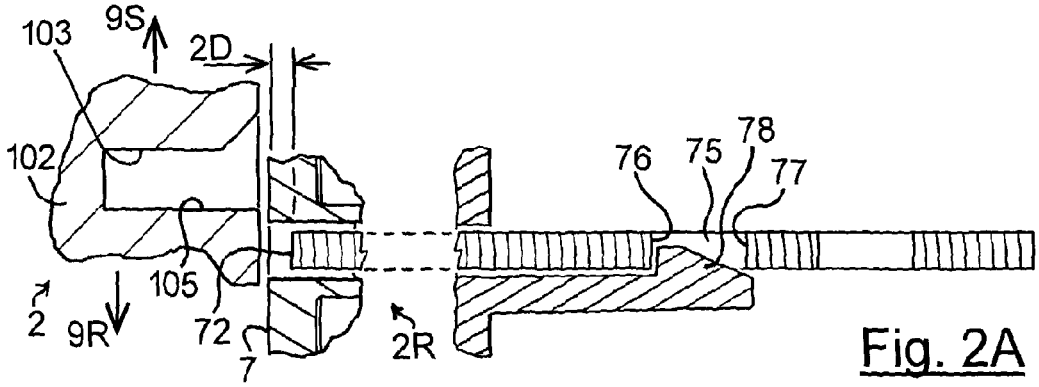
FIG. 2A is an enlarged scrap cross sectional view of the side view of the socket shown in FIG. 2, with a locking member in a retracted position.
Figure 2B:
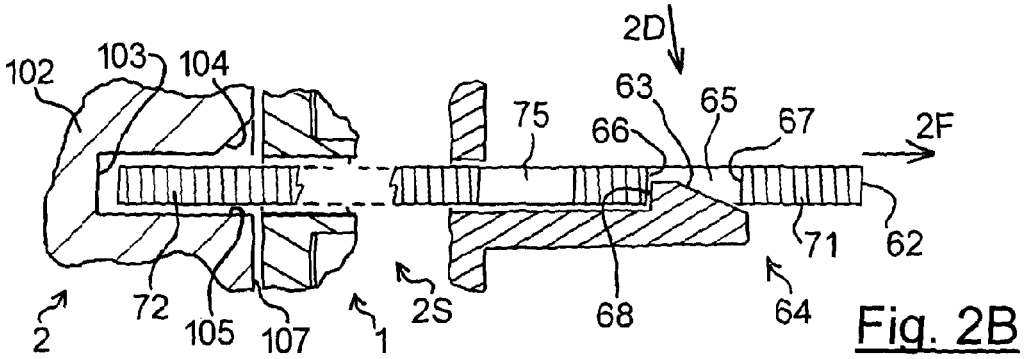
FIG. 2B is an enlarged scrap cross sectional view as shown in FIG. 2A, but with the locking member engaged with a plug.

The locking bar 71 is releasably retained in the retracted position shown in FIGS. 2 and 2A by a latching means 73. In the embodiment shown the latching means 73 comprises a resilient latch member 74 which is resiliently urged in the lateral direction 7L so as to engage with a first aperture 75 in the locking bar 71. From FIG. 2A, an enlarged scrap view of FIG. 2, the latch member 74 is shown latchably engaged with the locking bar 71 at first aperture 75. Protrusion 78 of the latch member 74 is resiliently urged to enter the aperture 75 so as to abut aperture end faces 76 and 77. In the retracted position, a external end 72 of the locking bar 71 is preferably positioned a small distance 2D below the externally facing surface 7. Hence a plug 2 having a plug body 102 may be moved about axis 9A in either direction 9R or 9S. When a user desires to move the locking bar in the direction of arrow 2E, force 7F is applied, either digitally or with a tool, to an internal end 62 of the locking bar 71. The end face 77 will then act on sloping face 63 of protrusion 78 so as to disengage the latch from the locking bar so that it can move from a retracted position 2R shown in FIG. 2A to an extended position 2S as shown in FIG. 2B. In the extended position 2S, protrusion 78 engages with second aperture 65, which has ends 66 and 67.

When the locking bar is in the extended position 2S shown in FIG. 2B an abutting face 68 of the latch member 74 abuts edge 66 of aperture 65 preventing the locking bar 71 from moving in a direction 2F.

From FIG. 2A, plug body 102 is shown in a partly engaged position, where it has been inserted into the socket 2, but not fully rotated in the direction of arrow 9R. Hence external end 72 is unable to enter a locking feature 103 in the plug body 102. If a force is applied to end 62, then the locking bar 71 can not move sufficiently to disengage the sloping face 63 from the hole 65, and hence the action of the sloping face on edge 67, will tend to return the locking bar to the disengaged position 2R shown in FIG. 2A.

Once the plug 2 has been fully engaged with the socket 2, the plug body will be positioned as shown in FIG. 2B, and the locking feature 103 will be aligned with the external end 72, so that when a force 7F is applied the bar will move past the protrusion 78 to the extended position 2S. In the extended position 2S, the end 72 is fully engaged with the locking feature 103 so as to prevent movement of the plug body in a direction 9S so as to disengage the plug from the socket. Note further movement in the direction of 9R is not possible in the embodiment shown, since as the plug is fully engaged, a leading edge 117 (FIG. 6) on the plug pins 110, 111, 112 will be abutting an end 87 of the apertures 80, 81, 82 preventing further rotation of the plug in the direction of arrow 9R.

Locking feature 103 may have a lead-in 104 on one or both sides to assist in ensuring the end 72 enters easily. The locking feature 103 has an abutment 105 to abut the member 71 when engaged with the locking feature 103. When the member 71 is engaged and abuts abutment 105, relative rotation of the plug and socket is prevented. Hence the plug is locked to the socket and can not be removed.

Internal end 62 is only accessible from an enclosed space 9 within an enclosure 18 to which the socket base 6 is mounted. Hence the locking means 70 is arranged to be only operable from within the enclosed space 9 behind the socket frontplate 5. The internal end 62 is an enclosed operating means 64 that can not be accessed without having first gained access to the enclosed space 9.

Hence the latching means 73 is arranged to releasably retain the member, locking bar 71, in the refracted position 2R. The latching means 73 provided in the socket 1 also latchably retains the member 71 in engaged position 2S. To move the locking bar 71 between positions 2R and 2S, access must be obtained to the enclosed space behind the socket. The plug body 102 when the plug is mounted to the socket covers socket fixing holes 33 and hence fixings 34 (only one shown in FIG. 3) fixing the annular mounting 4 to the enclosure 18. Hence when a plug is connected and locked, access to the enclosed operating means 64 can not be gained by removal of the socket. Gasket 36 is provided to ensure a weatherproof seal.

The locking bar 71 is slidably mounted and preferably a close fit within hole 69 in frontplate 5. The hole 69 provides support to the bar 71 to enable it to resist a turning moment 1T which is exerted on end 72 if it is attempted to remove the plug 2 from the socket 1 when locked by engagement of bar 71 with locking feature 103.

As an example, in a particular application where the socket 1 is mounted to a street lamp, the enclosure 18 is a lantern enclosure or luminaire enclosure. The plug is then insertable into the socket from external to the luminaire. Hence in this example, to operate or release the locking means 70, access to the enclosed operating means 64 is provided by a separate means such by opening or removing the lantern lens.

The enclosed operating means 64 can then be operated by applying force 7F to engage the means, or to disengage by applying a small tool, such as screwdriver 130 in a direction 3R so as to release the latch 73 and move the locking bar away from the plug in direction 2F. Screwdriver 130 is preferably small enough to enter the hole 75 so as to act on sloping face 63 to disengage faces 66 and 68.

In an alternative embodiment not shown herein, the latching member is arranged for digital manipulation to release the latch, and the locking bar 71 is provided with a grasping portion that may be digitally grasped to retract it.

In a yet further embodiment not shown herein, the locking bar is resiliently urged to the disengaged position, so that when the latch is released, the locking means operates to the released position 2R.

Figure 4:
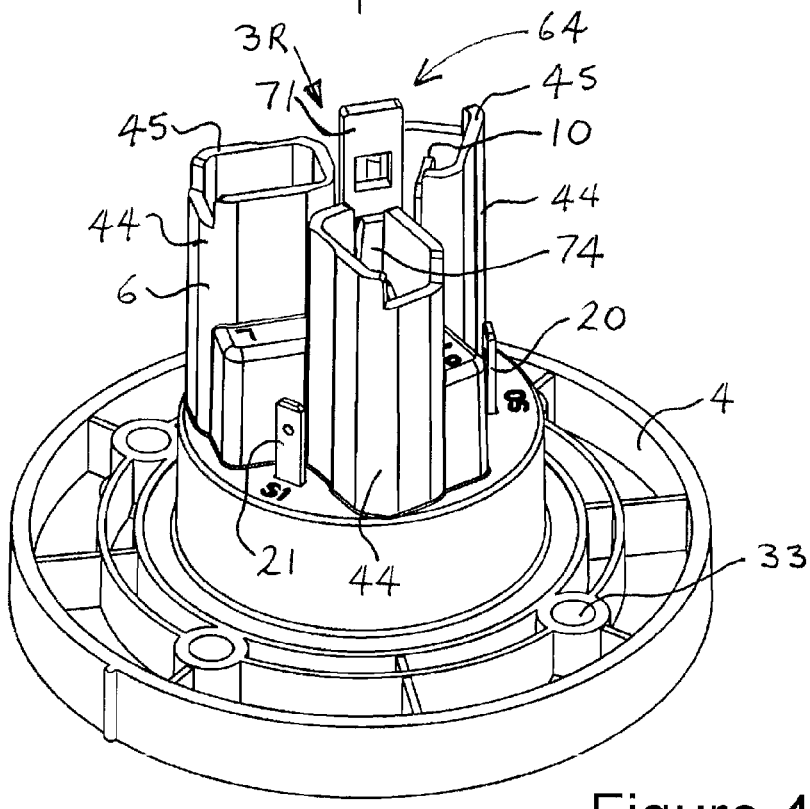
FIG. 4 is a rear perspective view of the socket shown in FIG. 1.

From FIG. 4, it can be seen that when in the retracted position 2R, the locking bar 71 protrudes a rear surface 45 of the base 6. Hence digital operation to the extended position 2S is facilitated. To ensure operator safety, upstanding shields 44 provide protective insulation against accidental contact with the terminals for the first set of socket contacts 13. When in the extended position 2S, the end 72 is substantially flush with or behind the rear surface 45 and protected against accidental release.

In other applications, by way of example, the enclosure 18 could be a mounting box or housing, such as a wall mounted flush back box, or the enclosure 18 could be part of an item of domestic electrical goods or an item of industrial electrical equipment. For the embodiments shown in the FIGS. 1 to 8, the enclosure 18 would be provided with means to access the enclosed space within the housing so as to enable operation of the locking means by manipulation.

In alternative embodiments not shown in the figures, where the locking means is arranged for remote operation, then access does not need to be provided to the enclosed space.

From FIGS. 1 and 5, it can be seen that the bar 72 has a longitudinal axis 5L, the longitudinal axis 5L being substantially parallel to and offset distance 5H from the common axis 9A. Hence, the locking bar 72 is moveable along the longitudinal axis 5L, in a direction parallel with the common axis 9A so as to engage the plug 2 when connected to the socket and following the subsequent relative rotation 9R. Likewise the aperture 69 is offset distance 5H from the common axis. The offset 5H is preferably less than a radius 6R of the contacts.

In another embodiment the offset 5H is preferably less than the radius 7R.

In a yet further embodiment the offset 5H is within an external diameter 8D of the socket.

External diameter 8D is less than an overall diameter 8P of the plug.

In a particular embodiment, suitable values for the external diameter 8D has been found to be approximately 67 mm, and for overall diameter 8P to be 154 mm. An overall height of plug and socket 8H is found to be 139 mm, and an overall height 8S of the socket 6 when in the retracted state 2R is found to be 57 mm.

Locking bar 71 is provided with nibs 52, arranged to extend laterally so that the bar 71 may not be completely withdrawn through aperture 69 in the frontplate or a corresponding aperture in the base 6. Hence once the socket is assembled, the locking bar is retained to the socket. Hence the locking means 70 is inseparably mounted to the socket 1.

A benefit of the locking means being mounted to the socket, is that the socket may receive a plug that is not adapted to be locked to the socket.

A benefit of the second set of contacts being set on a larger radius from the common centre axis 9A, but within a overall diameter 8D of the socket 2 is that a plug having only a first set of pins may be plugged into the socket if it only desired to make electrical connection to the first set of contacts.

While in the embodiment shown in the figures, the socket is provided with a frontplate 5 comprising a centre portion 3 mounted within an annular portion 4, in an alternative embodiment not shown herein, the frontplate may be formed as a single portion, with attachment means provided to attach a base portion corresponding to base 6 less the annular portion 4.

In an alternative embodiment not shown herein, the latching means is arranged for retraction to the retracted position, the retraction being only by application of an electrical signal. The retraction in this embodiment may conveniently be by means of a solenoid, or alternatively may be by means of a motor drive.

The embodiments of the invention discussed above provide an improved socket for making a disconnectable electrical connection with a plug. The invention, therefore, is well adapted to carry out the objects and attain the ends and advantages mentioned, as well as others inherent therein. While the invention has been described and is defined by reference to particular preferred embodiments of the invention, such references do not imply a limitation on the invention, and no such limitation is to be inferred. The invention is capable of considerable modification, alteration, and equivalents in form and function, as will occur to those ordinarily skilled in the pertinent arts. The described preferred embodiments of the invention are exemplary only, and are not exhaustive of the scope of the invention. Consequently, the invention is intended to be limited only by the scope of the appended claims, giving full cognizance to equivalents in all respects. Various embodiments of the present application obtain only a subset of the advantages set forth. No one advantage is critical to the embodiments. Any claimed embodiment may be technically combined with any other claimed embodiment(s).

The invention claimed is:

1. A socket comprising:

a plurality of contacts arranged for electrical connection with a plug, the electrical connection between the plug and the socket being made by insertion of the plug into the socket and subsequent relative rotation of the plug and the socket about a common axis;

at least a first electrical contact having a contact face in a plane substantially parallel to the common axis;

at least a second electrical contact having a contact face in a plane substantially perpendicular to the common axis, each of said contact faces arranged for making electrical contact with the plug; and a frontplate having an externally facing surface, the plurality of contacts being disposed substantially flush with or behind the externally facing surface, apertures being provided though the externally facing surface to receive plug pins, the apertures arranged such that the plug pins make electrical contact with a corresponding contact when a plug is fully inserted in the socket.

2. The socket as claimed in claim 1, wherein the socket further comprises a first set of electrical contacts and a second set of electrical contacts, the first set of electrical contacts being radially disposed about the common axis at a first pitch circle radius, and the second set of electrical contacts being radially disposed about the common axis at a second pitch circle radius;

wherein the first pitch circle radius is less than the second pitch circle radius;

wherein at least one aperture for one of the sets of contacts is of a different shape to at least another aperture for that set of contacts; and the said set of contacts being the first set.

3. The socket as claimed in claim 1, wherein:

the contacts are resiliently urged to make electrical contact with corresponding plug pins; and on insertion of a plug into the socket, electrical connection is made between the at least first electrical contact and a corresponding first plug pin before an electrical connection is made to the at least a second electrical contact and a corresponding second plug pin.

4. The socket as claimed in claim 1, wherein on insertion of a plug into the socket, the plug is removably retained in the socket by the subsequent relative rotation of the plug and socket;

and preferably wherein the at least first electrical contact further comprises a protrusion extending in a circumferential direction, the protrusion arranged to abut a rearward facing surface of a frontplate on the subsequent relative rotation.

5. The socket as claimed in claim 1, wherein the socket is mounted to a mounting surface and wherein at least an upstanding portion of the frontplate protrudes a surrounding mounting surface.

6. The socket as claimed in claim 1, wherein the socket is provided with a locking means, the locking means comprising at least a member moveable in a direction parallel with the common axis to engage the plug when connected to the socket and following the subsequent relative rotation so as to lock the plug to the socket;

wherein the locking means further comprises a latching means provided to latchably retain the member in an engaged position; the latching means being preferably provided in the socket; and wherein the member further comprises a bar having a longitudinal axis, the longitudinal axis being substantially parallel with and offset from the common axis.

7. The socket as claim in claim 6, wherein either the latching means is operable from between the engaged position and a retracted position;

the member being preferably behind an externally facing surface of a frontplate when in the retracted position;

the latching means being preferably arranged to releasably retain the member in the retracted position or the latching means is operable from between the engaged position and a retracted position; and the member being preferably behind an externally facing surface of the frontplate when in the retracted position, the latching means being resiliently urged from the retracted position to the engaged position.

8. The socket as claimed in claim 6, comprising:

a plurality of contacts arranged for disconnectable connection to plug pins, the contacts being radially disposed about the common axis within a maximum radius, the longitudinal axis being within the maximum radius;

wherein the locking means is arranged so that the member is arranged for manipulation to the engaged position, the manipulation being only from behind a socket frontplate; and wherein the latching means is arranged for manipulation to a retracted position, the manipulation being only from behind the socket frontplate.

9. The plug for connection to an electrical socket as claimed in claim 1, wherein the plug is arranged with a mating face substantially perpendicular to the common axis, the mating face arranged to face a frontplate externally facing surface when the plug is inserted in the socket, the plug further comprising:

at least a first set of pins arranged for making electrical contact with the first electrical contact and a second set of pins arranged for making electrical contact with the second electrical contact, the first set of pins protruding the mating face further than the second set of pins; and wherein the plug is removably retained to the socket by relative rotation of the plug with respect to the socket.

10. The plug as claimed in claim 9, wherein the plug comprises at least an abutment to abut a member when engaged, and preferably wherein the plug is prevented from relative rotation when the member is engaged.

11. The plug as claimed in claim 9, wherein the plug has a protruding wall, and wherein when the plug is connected to the socket, the wall extends in an axial direction around a periphery of an upstanding portion.

12. The plug and a socket as claimed in claim 1, wherein a compressible seal is provided between the plug and socket in a plane perpendicular to the common axis, the compressible seal being compressed when the plug is connected to the socket.

13. A luminaire having a socket according to claim 1, the plug being insertable into the socket from external to the luminaire.

* * * * *